United States Patent [19]

Judkins

[11] Patent Number: 4,880,044

[45] Date of Patent: Nov. 14, 1989

[54] SPACER DEVICES

[75] Inventor: Ren Judkins, Pittsburgh, Pa.

[73] Assignee: BW-USA, Inc., Pittsburgh, Pa.

[21] Appl. No.: 211,361

[22] Filed: Jun. 24, 1988

Related U.S. Application Data

[63] Continuation-in-part of Ser. No. 32,623, Apr. 1, 1987, abandoned.

[51] Int. Cl.[4] ..... A47H 5/00

[52] U.S. Cl. ..... 160/84.1

[58] Field of Search ..... 160/84 R, 236, 166, 160/32, 34, 35

[56] References Cited

U.S. PATENT DOCUMENTS

| | | | |
|---|---|---|---|
| 2,049,518 | 8/1936 | Schier | 160/84 R |
| 2,071,830 | 2/1937 | Guyer | 160/84 R |
| 2,260,101 | 10/1941 | Defalco | 160/84 R |
| 2,509,033 | 5/1950 | Carver | 160/84 R |
| 2,874,612 | 2/1959 | Luboshez | 160/84 R X |
| 4,444,238 | 4/1984 | Adler | 160/84 R |
| 4,544,011 | 10/1985 | Sawamura | 160/84 R |

*Primary Examiner*—Robert W. Gibson, Jr.
*Attorney, Agent, or Firm*—Wolf, Greenfield & Sacks

[57] ABSTRACT

A spacer device for controlling the spacing between selected portions of a horizontally or vertically mounted shade, drapery or other covering. The spacer is formed of a thin piece of material of predetermined length. For some embodiments, the material has projections extending at selectd intervals along the length of the piece of material, the projections being adapted to co-act with a cord used to control the opening and closing of the covering and preferfably with selected areas of the covering to control the spacing of the selected portions of the covering. The piece of material is preferably a cord and the projections are preferably loops extending from the cord. For other embodiments, the piece of material is stiff and extends between bars or rails fixed to the covering to control the spacing between the bars or rails when the covering is open. When the opening is closed, the stiff piece of material is guided, preferably by the cord holes, into a rail so that it does not extend from the covering.

29 Claims, 2 Drawing Sheets

SPACER DEVICES

RELATED APPLICATION

This application is a continuation in part of application Ser. No. 032,623 filed Apr. 1, 1987, now abandoned.

FIELD OF THE INVENTION

This invention relates to spacer devices and more particularly to spacers adapted for use in pleated shades, draperies or other coverings for windows or other openings which spacers control the spacing between portions of the covering when the covering is open and stack neatly when the covering is closed.

BACKGROUND OF THE INVENTION

For purposes of this invention, a pleated shade shall be defined as a shade, blind, screen, curtain, or other similar member for covering an opening which, when in its closed condition to expose the opening, stacks generally along predetermined creases or lines and which, when in its open condition to cover the opening, opens each pleat to only a predetermined extent so that the pleat is maintained. Pleated shades are generally formed from a web-type material which retains its folds, for example impregnated textile fabric, paper or board type material, metalized textile material, etc. Other materials may also be used such as plastics and metals. Such shades are for example shown in U.S. Pat. No. 3,946,788 entitled "Foldable Curtain Screen or Blind Construction and a Method for Producing a Curtain Blind Construction" which issued March 30, 1976 to Hendrik van Muyen. Other forms of pleated shades include, but are not limited to, the various honeycomb and other shade configurations shown in co-pending application Ser. No. 030,167 entitled "Shade and Method for the Manufacture Thereof", filed March 25, 1987. While most pleated shades open and close in the vertical direction, pleated shades may also be oriented to open and close horizontally. Shades of this type are shown in co-pending application Ser. No. 788,460 entitled "Vertical Drape System" filed Oct. 17, 1985, and various continuations thereof.

One problem in pleated shades, particularly long heavy pleated shades, is that the weight of the shade when the shade is in its open position, covering the opening, causes the pleats in the shade, particularly the pleats in the upper portion of the shade, to be stretched. In some instances the stretching is sufficient so that the pleat disappears and the shade hangs straight. The stretching of the pleats in this manner is disadvantageous for at least two reasons. First, the pleats being stretched unevenly over the length of the shade, and in some instances disappearing, is aesthetically unacceptable in most applications where pleated shades are utilized. Second, the stretched pleats may not stack properly when the shade is closed. This is particularly true for shades which may be subjected to wind, jostling or other external forces which may crease or even break the fabric if it is in a substantially flattened condition. Properly pleated fabric is far more resistant to damage from such forces.

To maintain a substantially uniform stretching of the pleats in relatively long shades and in other selected situations, it has been the practice to attach a middle rail to the shade at a selected point between the headrail and the bottomrail and to attach one or more spacer straps between the headrail and middlerail. These straps, which are of a predetermined length, control the spacing between the headrail and middlerail, and thus the extent to which the pleats in the upper portion of the shade above the middlerail may be extended. For very long shades, two or more middlerails may be utilized with spacer straps connected between successive middlerails to control the spacing therebetween and to thus assure substantially uniform extension of the pleats over the length of the shade. In some applications, one or more spacers may also be connected between the bottomrail and the headrail or a middlerail.

With standard spacers of the type described above, the length of the material between rails may still be sufficient such that the pleats do not extend uniformly between the rails, resulting in the aesthetic and other problems indicated above. A need therefore exists for a spacer device which, in addition to controlling the spacing between end bars or rails, is also adapted to provide additional support to the pleats of a pleated shade to further maintain uniform extension of the pleats.

As previously indicated, pleated shades may also be hung so as to open and close horizontally rather than vertically. For such shades, there is also a problem maintaining uniform extension of the pleats and a spacer means is required which will be effective to maintain uniform pleat extension in horizontally hung shades as well as vertically hung shades.

Another problem with existing spacers is that, when the shade is closed, the spacer collapses into one or more loops extending from the rear or side of the shade. Since the spacers are frequently relatively long, up to several feet, these loops can also be relatively long, and may be aesthetically unacceptable in some applications. Further, if the rear projecting loops are too long, they may come in contact with the window or other opening being covered, or may rub on the floor for horizontally hung shades, interfering with the operation of the shade. A need therefore exists for a spacer which is designed such that the extent to which it projects from any side of the shade when the shade is closed is limited so as not to be either aesthetically objectionable or to interfere with the operation of the shade.

Still another potential problem with existing spacers is that at least portions of the spacer itself or a shadow of the spacer may be visible from the front of the shade when the shade is open. In some applications, this may be aesthetically objectionable.

While spacers of the type described above are particularly useful in connection with pleated shades, similar problems may arise in other types of shades such as weeping roman shades, where moveable ribs support loops of fabric therebetween and it is desired that the spacing between ribs be substantially uniform to provide uniform fabric draping. Similar problems requiring the use of spacers also arise in other types of shades or other coverings.

SUMMARY OF THE INVENTION

In accordance with the teachings of this invention, a device is provided for use in a pleated shade having at least two bars, a piece of pleated material connected between the bars, and cord means for controlling the opening and closing of the shade and for controlling the stacking thereof. The device is operative for controlling the spacing between the bars, and thus the extent to which the pleats in the material are extended. The device includes a spacer means of predetermined length; a first means which is operative when the shade is in its fully opened position, covering the opening, for causing the spacer means to interact with the bars to limit the space therebetween; and a second means which is operative in conjunction with the cord means when the shade is in its fully closed position, exposing the opening, for limiting the extent to which the spacer means projects from a side of the shade.

For a first embodiment, one of the bars is a hollow rail, for example the headrail and has a hole therein adjacent the shade. The spacer means is a length of stiff, flexible material, such as a length of plastic line, which passes through the hole in the rail. There is a means on the end of the length of material which is on the inside of the rail preventing the length of material from being pulled through the hole and there is a means for attaching the other end of the length of material to the other bar. The second means includes means for guiding the length of material into the rail as the shade is closed. The means for guiding may include cord openings in the material through which the spacer also passes.

For a second embodiment, the spacer means has at least one, and preferably a plurality of projections extending therefrom at intervals along its length. A means is provided for connecting the projections to a cord of the cord means in a manner such that the cord means may move in its axial direction relative to the spacer means. The connecting means may be a hook connected to the projection, or the projection may be in the form of a loop which a cord of the cord means passes through. In the alternative, the spacer may pass through the same row of cord holes as a cord of the cord means. The spacer means may also include means coacting with at least selected pleats of a pleated shade to support the weight of the pleats.

More generally, the invention provides a spacer which is adapted for use to control the spacing between selected portions of horizontally or vertically mounted coverings. The spacer comprises a thin piece of material of predetermined length and projections extending at selected intervals along the length of the piece of material. The projections are adapted to coact with a cord of the cord means, and with selected areas of the covering to control the spacing of such portions. The piece of material is preferably a cord and the projections are preferably loops extending from the cord.

The foregoing and other objects, features and advantages of the invention will be apparent from the following more particular description of preferred embodiments thereof as illustrated in the accompanying drawings.

IN THE DRAWINGS

DETAILED DESCRIPTION

Figure 1:
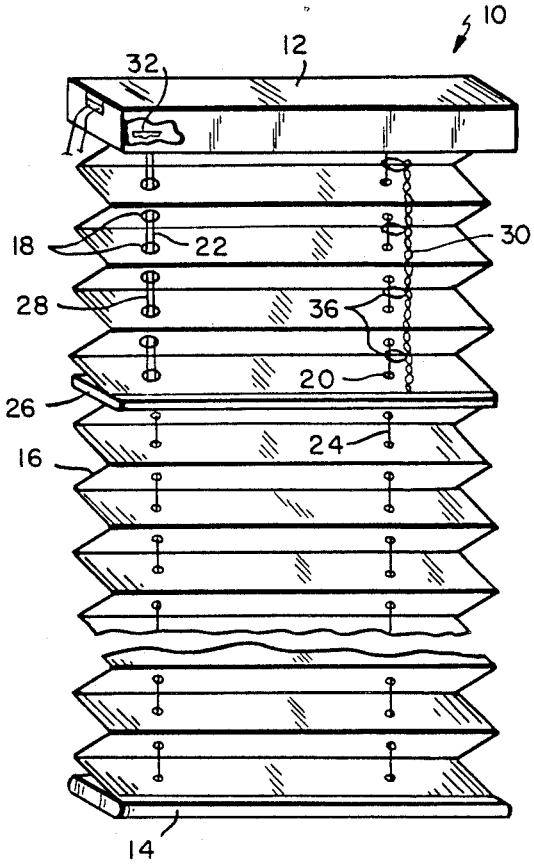
FIG. 1 is a rear perspective view of a shade employing spacers of this invention with the shade in its open position.
Figure 2:
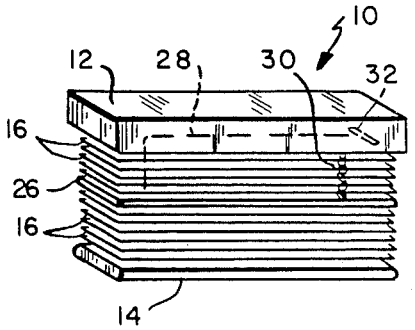
FIG. 2 is a rear perspective view of the shade of FIG. 1 in its closed position.

Referring to FIGS. 1 and 2, a pleated shade 10 is shown which has a hollow headrail 12, a bottomrail 14 and a piece of pleated material 16 connected at one end to the headrail and at the other end to the bottomrail. A first vertically-aligned row of holes 18 and a second vertically aligned row of holes 20 are formed in material 16. A cord 22 extends from headrail 12 through each of the holes 18 and terminates at bottomrail 14. A cord 24 extends from headrail 12 through each of the holes 20 and also terminates at bottomrail 14. The cords 22 and 24, which may be formed as a single cord loop, are utilized to open and close shade 10 and are also operative to control the stacking of the shade. A middlerail 26 is connected to a rear-projecting pleat of material 16 at a selected point intermediate headrail 12 and bottomrail 14. A spacer 28 and a spacer 30 are connected, in accordance with the teachings of this invention, between headrail 12 and middlerail 26. While for purposes of illustration, spacers 28 and 30 in the Figures are of different embodiments of the invention, it is to be understood that the spacers utilized for a shade would normally all be of the same type.

Figure 3:
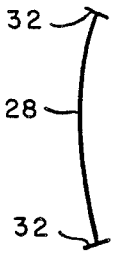
FIG. 3 is a side view of a spacer of the first embodiment of this invention.

Referring to FIG. 3, it is seen that spacer 28 is a length of stiff flexible material having a T-shaped projection 32 formed at each end. Spacer 28 may for example be plastic line such as fishing line, braided wire, or other similar material. Further, while T-shaped projections have been shown at each end of spacer 28, the shape of the ends of the material will depend on the material from which the spacer is formed and the bars or rails with which it is to interact. Thus, ends 32 of spacer 28 could be knots, balls, loops, hooks, or other similar connecting elements.

Figure 4:
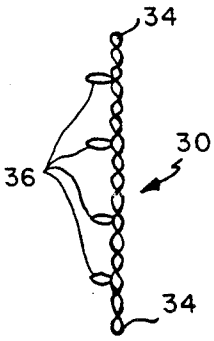
FIG. 4 is a side view of a spacer of a second embodiment of this invention.

FIG. 4 shows the spacer 30 in greater detail. This spacer has a loop 34 formed at each end for connection to the rails or bars and a plurality of loops 36 extending from one side thereof at substantially uniform intervals. Spacer 30 may for example be formed of braided cord.

Spacer 28 is secured to middlerail 26 by having its bottom T-projection 32 fit in a corresponding groove formed in rail 26 or by other suitable means. As indicated previously, the exact manner of connection will depend on the material of the spacer and the nature of the rail and does not form part of the present invention. The spacer 28 extends from rail 26 through holes 18 (adjacent to cord 22) and projects through a hole 38 into headrail 12. When the shade is in its open condition as shown in FIG. 1, T-projection 32 rests on the bottom wall of headrail 12, as shown in FIG. 1, causing the spacer to be stretched between headrail 12 and middlerail 26 to control the spacing between these two rails. When the shade is closed as shown in FIG. 2, spacer 28 is guided into headrail 12 by holes 18 and the headrail and assumes the position therein shown by the dotted lines in FIG. 2. If spacer 28 is stiff enough, it may not be necessary to pass it through holes 18. Thus, there is no spacer loop projecting from the rear or other side of the shade with this embodiment of the invention. Further, since the spacer 28 is in the same holes 18 as the cord 22, it does not appear as an additional element visible from the front of the shade when the shade is open. However, this embodiment of the invention is limited in that the length of the spacer utilized cannot exceed the width of headrail 12 from the hole 38 to the end of the headrail furthest therefrom. This embodiment also does not provide support for the weight of the pleats at points intermediate the ends of the spacer.

For a second embodiment of the invention, spacer 30 is attached at its lower end to middlerail 26 by for example having the rail pass through lower loop 34 of the spacer or by a suitable connector element and is attached at the other end to headrail 12 by suitably securing top loop 34 to the headrail. Again, as previously indicated, the nature of the end members on spacer 30 will vary with the bars or rails to which the spacer is to be connected. While in FIG. 1 each portion of cord 20 which is visible from the rear of the shade passes through a corresponding loop 36 of spacer 30, this is not essential, and the invention may be practiced with only selected cord portions passing through loops.

Thus, when the shade is in its open position as shown in FIG. 1, spacer 30 is operative to control the spacing between rails 12 and 26. When in this position, the spacer is directly behind the cord 24 and therefore does not create an additional shadow visible from the front of the shade. When the shade is in its closed position as shown in FIG. 2, cord 24 interacts with the loops 36 to form the spacer into a plurality of relatively short loops which are not easily visible and are therefore far less aesthetically objectionable than a single or small number of relatively large spacer loops, and which will not contact the window or other opening being covered or otherwise interfere with the operation of the shade. In addition to causing spacer 30 to be neatly stacked when the shade is in its closed position, the loops 36 of spacer 30 also coact with the material of the pleated shade to support part of the weight of the adjacent pleat and to thus assure substantially uniform pleat spacing and extension. The spacer 30 is thus adapted to control the spacing and extension of the shade pleats in two ways, first by controlling the total extension of the shade between bars, rails or ribs, and second by the loops supporting the weight of the pleats at intermediate points and controlling the final relative location of the pleats.

Figure 5:
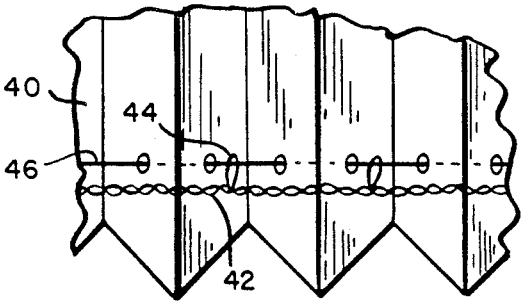
FIG. 5 is a rear perspective view of a portion of a horizontally-hung shade utilizing a spacer of this invention.

FIG. 5 illustrates an alternative embodiment of the invention in which the shade 40 is hung horizontally rather than vertically. As previously indicated, while spacers are not necessarily required to support the weight of the shade in such application, the spacer is still required to assure uniform spacing of the pleats for both aesthetic reasons and to assure that the shade folds along the proper lines when reclosed, and otherwise to avoid damage to the pleats as a result of wind, jostling or the like. A spacer 42 is thus provided with loops 44 through which a control cord 46 passes. The loops 44 coact with the material of shade 40 to assure a controlled desired spacing between the pleats when &he shade is open, and coact with the cord 44 to limit the size of any spacer extensions from a side of the shade when the shade is in its closed position.

Figure 6:
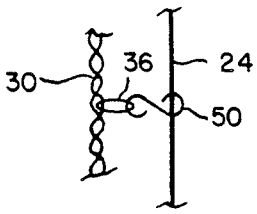
FIG. 6 is a side view of a portion of spacer and cord illustrating an alternative embodiment for connecting these elements to coact with each other.
Figure 7:
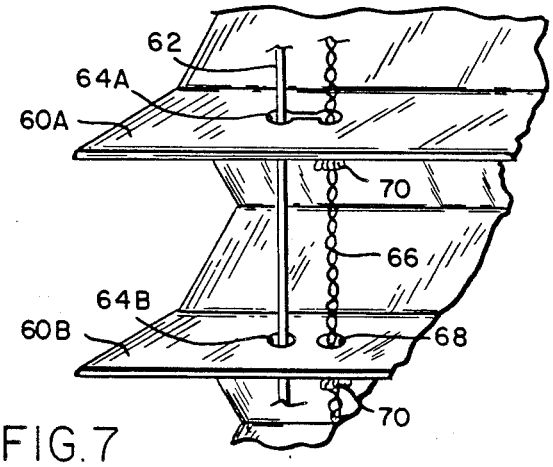
FIG. 7 is a rear perspective view of a portion of a shade illustrating another manner in which the spacer, cord, and shade may coact in accordance with the teachings of this invention.

FIGS. 6 and 7 illustrate alternative ways in which the cords and spacers may interact. In FIG. 6, instead of the cord 20 passing directly through the loop 36, an S-shaped hook 50 is provided which connects at one end to the spacer 36 and at the other end to cord 24. In many applications it is easier to connect the spacer to cords 24 using hooks 50 than to attempt to run the cords directly through the loops. Obviously, the hooks 50 may take a variety of forms, and may in fact be rings, clips, or other devices which connect the loops 36 to the cords in a manner such that the cords may move in their axial direction relative to the spacer. Further, while loops S6 have been shown in FIG. 6, where a clip or similar device 50 is utilized, it is merely required that there be some projection from the spacer 30 to which the clip may attach, which projection need not necessarily be a loop. In some applications it may also be possible to force the hook or other connecting device through the braided cord of spacer 30 at appropriate positions, or to otherwise secure the device to the braided cord or other form of the spacer so that the connecting device itself forms the projection from the spacer rather than having a loop or other projection formed as an integral part of the spacer.

FIG. 7 illustrates another embodiment of the invention wherein the shades are of the type shown in the beforementioned application Ser. No. 030,167 wherein a tab 60 extends from each rear pleat and each cord 62 of the shade extends through a corresponding row of holes 64 formed in the tabs 60. The advantage of this arrangement is that the cords 62 are not visible from the front of the shade, and there are no cord holes in the shade through which light may pass and which reduce the insulating effect of the shade. In FIG. 7, the cord hole 64A in tab 60A is shown as being slightly enlarged so that spacer 66, which is shown in the form of a braided cord, may pass through the same hole as cord 62. As an alternative, a hole 68 is shown which is closely adjacent to hole 64B through which the spacer 66 passes in tab 60B. The hole configurations shown in FIG. 7 are obviously alternatives, only one of which would be employed for a given shade. Spacer 66 has an enlargement 70 formed therein at a point under each of the tabs 60 which prevents the spacer at the enlarged point from passing through the corresponding holes 64 or 66 and thus maintains a desired inter-pleat spacing and serves to support at least in part the weight of the pleats. Enlargements 70 may be a loop or other projection, or may be a knot, washer, crimped ball or the like formed in or attached to spacer 66 at that point.

Figure 8:
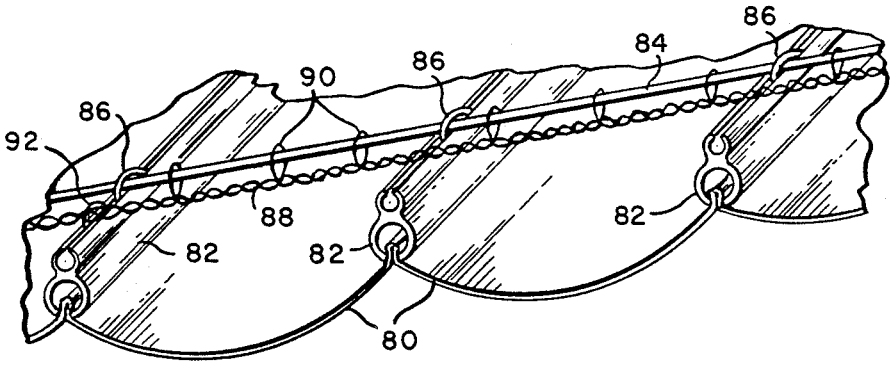
FIG. 8 is a rear perspective view of a weeping roman shade utilizing a spacer in accordance with the teachings of this invention.

FIG. 8 illustrates that the spacer of this invention may also be utilized with shades other than pleated shades. In FIG. 8, a weeping roman shade is shown. For this shade, a piece of material 80 is connected along its entire width at periodic intervals to ribs 82. A pull cord 84 passes through rings 86 formed in each rib. A spacer, which for purposes of illustration is shown in the form of a braided cord 88, is provided which has loops 90 through which pull cord 84 passes and which spacer is attached by suitable means 92 to each of the ribs 82. Means 92 may for example be a nail, staple, or a ring on the rib, and a suitable enlargement such as the enlargement 70 on spacer 88 which enlargement cannot pass through the ring. The spacer thus functions to partially support the weight of the shade and ribs and to control the spacing between the ribs so as to assure an aesthetically pleasing uniform hang for the shade when in its open position and that the shade will drape properly when in its closed position.

It is apparent that, while the two rails attached to the spacers in FIGS. 1 and 2 are a headrail and a middlerail, in some applications the rails connected might be two middlerails, a middlerail and bottomrail, or some other combination. Further, the word "bar" shall be understood to include not only a rail, rib or bar, but also tabs such as are shown in FIG. 7, or other structural elements to which a spacer may be attached. The size, shape and type of the shade may of course vary with application. Thus, while the invention has been described above with respect to various embodiments, the foregoing and other changes in form and detail may be made therein by one skilled in the art without departing from the spirit and scope of the invention.

What is claimed is:

1. A pleated shade having at least two bars, a piece of pleated material connected between the bars and cord means for controlling the opening and closing of the shade and for controlling the stacking thereof, a device for controlling the spacing between the bars, and thus the extent to which the pleats in the material are extended, comprising:

spacer means of predetermined length;

first means operative when the shade is in its fully open position for causing said spacer means to interact with both of said bars to limit the space therebetween; and second means operative in conjunction with said cord means when the shade is in its fully closed position for limiting the extent to which said spacer means projects from a side of the shade.

2. A device as claimed in claim 1 wherein at least one of said bars is a hollow rail with a hole therein adjacent said shade;

wherein said spacer means is a length of stiff, flexible material which passes through said hole;

wherein said first means includes means on the end of said length of material inside the rail for preventing the length of material from being pulled through the hole, and means for attaching the other end of the length of material to the other bar; and wherein said second means includes means for guiding the length of material into the rail as the shade is closed.

3. A device as claimed in claim 2 wherein said means for guiding includes a row of cord holes in said material in the portions thereof between the bars, the spacer means passing through the holes and being guided thereby.

4. A device as claimed in claim 2 wherein said spacer means is a length of plastic line.

5. A device as claimed in claim 1 wherein said first means includes means for attaching each end of said spacer means to a different one of said bars; and wherein said second means includes at least one projection from an intermediate point on said spacer means, and means for connecting said projections to a cord of said cord means in a manner such that the cord means may move in its axial direction relative to said spacer means.

6. A device as claimed in claim 5 wherein each said projection is a loop; and wherein said means for connecting includes means for passing a cord of said cord means through each loop.

7. A device as claimed in claim 5 wherein there are a plurality of said loops projecting at intervals from the spacer means; and wherein said cord passes through said loops.

8. A device as claimed in claim 7 wherein said loops project at substantially equal intervals from said spacer means.

9. A device as claimed in claim 7 wherein said spacer means is a length of braided cord having said loops projecting at intervals therefrom.

10. A device as claimed in claim 5 wherein said means for connecting includes a hook connected between said projection and cord.

11. A device as claimed in claim 1 wherein each cord of said cord means passes through a row of cord holes in the material; and wherein said spacer means passes through the same row of cord holes as at least one of said cords.

12. A device as claimed in claim 11 wherein at least one of said bars is a hollow rail with a hole therein adjacent said shade;

wherein said spacer means is a length of stiff, flexible material which passes through said hole;

wherein said first means includes means on the end of said length of material inside the rail for preventing the length of material from being pulled through the hole, and means for attaching the other end of the length of material to the other bar; and wherein said second means includes means for guiding the length of material into the rail as the shade is closed.

13. A device as claimed in claim 11 wherein said spacer means includes means coacting with at least selected pleats of the pleated material to support the weight of the pleats.

14. A device as claimed in claim 13 wherein the spacer means is a cord;

wherein the means to support the weight includes means positioned at selected intervals along the spacer cord for increasing the spacer thickness such that it will not at such points pass through the cord holes.

15. A spacer adapted for use in a pleated shade having a hollow rail with a hole formed therein, one or more bars, a piece of pleated material connected between the bars and cord means for controlling the opening and closing of the shade and for controlling the stacking thereof, the spacer comprising:

a length of stiff flexible material which passes through said hole in the rail, said material having a predetermined length;

means on the end of said length of material inside the rail for preventing the length of material from being pulled through the hole;

means for attaching the other end of the length of material to the bar; and means for guiding the length of material into the rail as the shade is closed;

whereby the spacer controls the spacing between said bars and thus the extent to which the pleats in the material are extended when the shade is in its open position and is out of sight when the shade is in its closed position.

16. A spacer as claimed in claim 15 wherein said means for guiding includes a row of cord holes in said material in the portion thereof between the rail and bar, the length of material passing through the holes and being guided thereby.

17. A spacer as claimed in claim 15 wherein said length of material is a plastic line.

18. A spacer adapted for use to control the spacing between selected portions of horizontally or vertically mounted covering, the opening and closing of said covering being controlled by cord means including one or more cords, the spacer comprising:

a thin piece of material of predetermined length;

projections extending at selected intervals along the length of said piece of material;

said projections being adapted to coact with a cord of said cord means and with selected areas of the covering to control the spacing of said portions.

19. A spacer as claimed in claim 18 wherein said piece of material is a cord.

20. A spacer as claimed in claim 19 wherein said cord is a braided cord.

21. A spacer as claimed in claim 18 wherein said projections are loops.

22. A spacer as claimed in claim 21 wherein the cord coacts with the loops by passing through each loop.

23. A spacer as claimed in claim 18 including means for connecting the projections to the cord in a manner such that the cord means may move in its axial direction relative to said spacer.

24. A spacer as claimed in claim 23 wherein said means for connecting includes a hook means for each projection.

25. A spacer as claimed in claim 18 wherein said projections project at equal intervals from said piece of material.

26. A spacer as claimed in claim 18 wherein each cord of said cord means passes through a row of cord holes in the piece of material; and wherein said piece of material passes through the same row of cord holes as at least one of said cords.

27. A spacer as claimed in claim 26 wherein said projections increase the thickness of the piece of material at the points where they extend such that the piece of material will not pass through the cord holes at such points.

28. A spacer as claimed in claim 18 wherein said covering is vertically mounted; and wherein said projections coact with at least selected areas of said covering to support the weight of such areas.

29. A spacer as claimed in claim 18 wherein said piece of material is a length of braided cord; and said projections are loops extending at intervals from the braided cord.

* * * * *

UNITED STATES PATENT AND TRADEMARK OFFICE

CERTIFICATE OF CORRECTION

PATENT NO. : 4,880,044

DATED : November 14, 1989

INVENTOR(S) : REN JUDKINS

It is certified that error appears in the above-identified patent and that said Letters Patent is hereby corrected as shown below:

Column 5, line 61, change "&he" to --the--.

Column 6, line 8, change "S6" to --36--.

Signed and Sealed this

Eighteenth Day of December, 1990

*Attest:*

HARRY F. MANBECK, JR.

*Attesting Officer*

*Commissioner of Patents and Trademarks*